US011527845B2

(12) United States Patent
Myer et al.

(10) Patent No.: US 11,527,845 B2
(45) Date of Patent: Dec. 13, 2022

(54) SPRING CLIP AND CONNECTOR FOR A FLAT FLEXIBLE CABLE

(71) Applicant: TE Connectivity Services GmbH, Schaffhausen (CH)

(72) Inventors: John Mark Myer, Middletown, PA (US); Hurley Chester Moll, Middletown, PA (US); Forrest Irving Kinsey, Jr., Middletown, PA (US); Ryan David Hetrick, Middletown, PA (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/064,011

(22) Filed: Oct. 6, 2020

(65) Prior Publication Data

US 2021/0408709 A1 Dec. 30, 2021

Related U.S. Application Data

(60) Provisional application No. 63/043,387, filed on Jun. 24, 2020.

(51) Int. Cl.

| | |
|---|---|
| ***H01R 13/426*** | (2006.01) |
| ***H01R 13/187*** | (2006.01) |
| ***H01R 13/508*** | (2006.01) |
| ***H01R 12/59*** | (2011.01) |
| ***H01R 12/88*** | (2011.01) |
| ***H01R 12/89*** | (2011.01) |
| ***H01R 4/2404*** | (2018.01) |
| ***H01R 12/85*** | (2011.01) |
| ***H01R 13/11*** | (2006.01) |
| *H01R 12/77* | (2011.01) |

(52) U.S. Cl.

CPC ..... *H01R 13/426* (2013.01); *H01R 4/2404* (2013.01); *H01R 12/592* (2013.01); *H01R 12/85* (2013.01); *H01R 12/88* (2013.01); *H01R 12/89* (2013.01); *H01R 13/113* (2013.01); *H01R 13/187* (2013.01); *H01R 13/508* (2013.01); *H01R 12/772* (2013.01); *H01R 12/778* (2013.01)

(58) Field of Classification Search

None

See application file for complete search history.

(56) References Cited

U.S. PATENT DOCUMENTS 3,336,565 A 8/1967 Crimmins
3,989,336 A * 11/1976 Rizzio, Jr. ..... H01R 12/62 439/260

(Continued)

FOREIGN PATENT DOCUMENTS

DE 1590474 A1 5/1970

OTHER PUBLICATIONS

International Search Report, Intl App No. PCT/IB2021/055626, dated Sep. 21, 2021, 3 pages.

*Primary Examiner* — Ross N Gushi

(57) ABSTRACT

A spring clip for a flat flexible cable includes a first beam and a second beam connected to the first beam and resiliently deflectable toward the first beam. The second beam has a first contact bend extending toward the first beam. The flat flexible cable is positioned between the first beam and the second beam and the first contact bend abuts a conductor exposed through an insulation material of the flat flexible cable to electrically connect the spring clip with the conductor.

18 Claims, 12 Drawing Sheets

(56) References Cited

U.S. PATENT DOCUMENTS

| | | | | | |
|---|---|---|---|---|---|
| 4,241,498 | A * | 12/1980 | Brandeau | H01R 12/68 | 29/857 |
| 4,530,553 | A * | 7/1985 | Aujla | H01R 12/82 | 439/260 |
| 6,979,224 | B2 * | 12/2005 | Boemmel | H01R 12/592 | 439/492 |
| 7,789,688 | B2 * | 9/2010 | Hemmi | H01R 12/88 | 439/495 |
| 8,651,885 | B2 * | 2/2014 | Ashibu | H01R 12/87 | 439/328 |
| 11,114,786 | B2 * | 9/2021 | Kim | H01R 13/26 | |

* cited by examiner

SPRING CLIP AND CONNECTOR FOR A FLAT FLEXIBLE CABLE

CROSS-REFERENCE TO RELATED APPLICATION

This application claims priority under 35 U.S.C. § 119 to U.S. Provisional Patent Application No. 63/043,387, filed on Jun. 24, 2020.

FIELD OF THE INVENTION

The present invention relates to a connector and, more particularly, to a connector having a spring clip for connection to a flat flexible cable.

BACKGROUND

As understood by those skilled in the art, flat flexible cables (FFCs) or flat flexible circuits are electrical components consisting of at least one conductor (e.g., a metallic foil conductor) embedded within a thin, flexible strip of insulation. Flat flexible cables are gaining popularity across many industries due to advantages offered over their traditional "round wire" counter parts. Specifically, in addition to having a lower profile and lighter weight, FFCs enable the implementation of large circuit pathways with significantly greater ease compared to round wire-based architectures. As a result, FFCs are being considered for many complex and/or high-volume applications, including wiring harnesses, such as those used in automotive manufacturing.

The implementation or integration of FFCs into existing wiring environments is not without significant challenges. In an automotive application, by way of example only, an FFC-based wiring harness would be required to mate with perhaps hundreds of existing components, including subharnesses and various electronic devices (e.g., lights, sensors, etc.), each having established, and in some cases standardized, connector or interface types. Accordingly, a critical obstacle preventing the implementation of FFCs into these applications includes the need to develop quick, robust, and low resistance termination techniques which enable an FFC to be connectorized for mating with these existing connections.

A typical FFC may be realized by applying insulation material to either side of a pre-patterned thin foil conductor, and bonding the sides together via an adhesive to enclose the conductor therein. Current FFC terminals include piercing-style crimp terminals, wherein sharpened tines of a terminal are used to pierce the insulation and adhesive material of the FFC in order to attempt to establish a secure electrical connection with the embedded conductor. In harsh environmental conditions, however, such a connection suffers from plastic creep and stress relaxation of the metal, leading to inconsistent electrical connectivity between the conductor and the terminal and mechanical unreliability over time. Terminals can alternatively be soldered to the FFC, but soldering increases the difficulty in assembly and requires inspection.

SUMMARY

A spring clip for a flat flexible cable includes a first beam and a second beam connected to the first beam and resiliently deflectable toward the first beam. The second beam has a first contact bend extending toward the first beam. The flat flexible cable is positioned between the first beam and the second beam and the first contact bend abuts a conductor exposed through an insulation material of the flat flexible cable to electrically connect the spring clip with the conductor.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
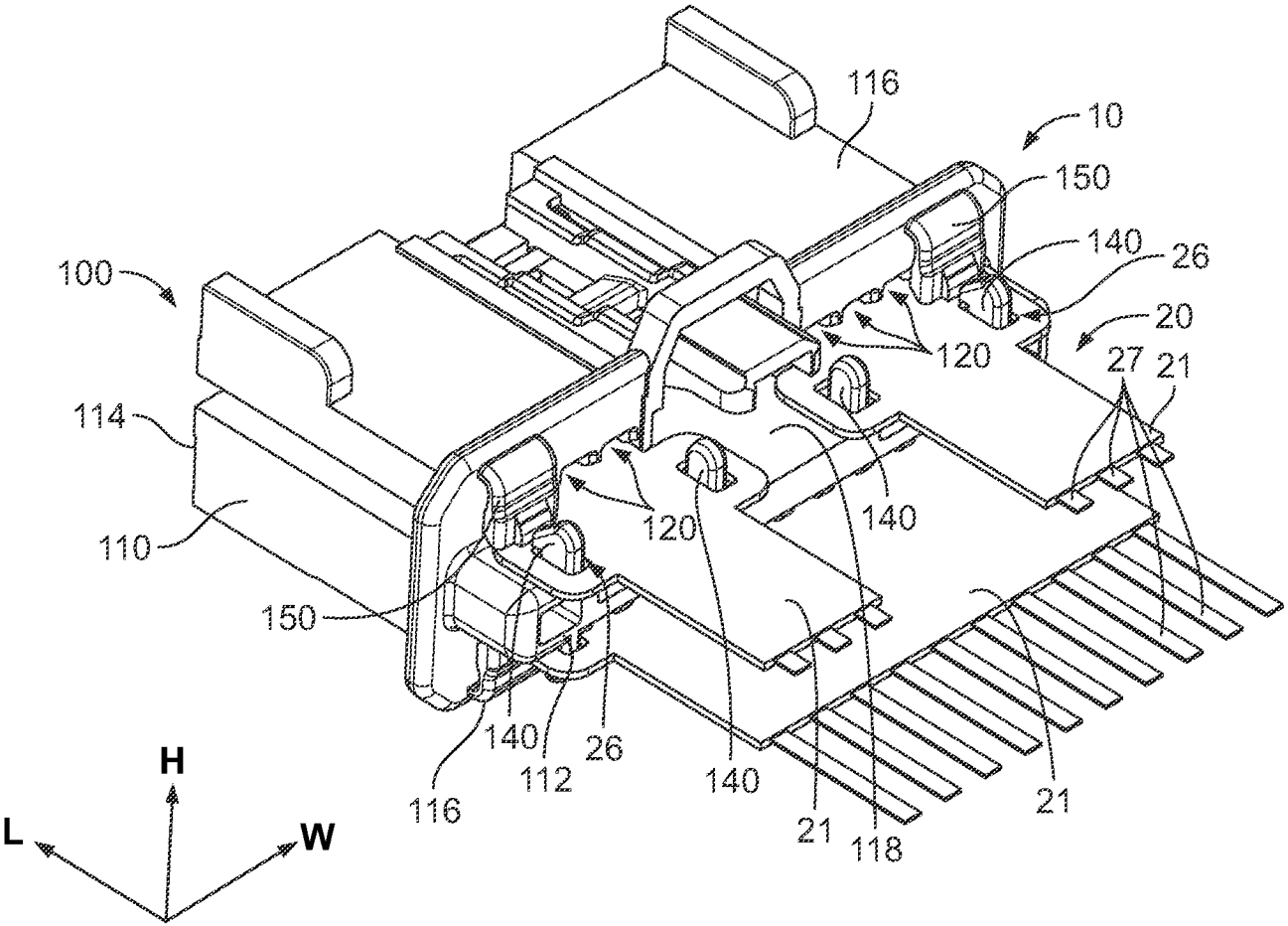
FIG. 1 is a perspective view of a connector assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

A connector assembly 1 according to an embodiment is shown in FIG. 1. The connector assembly 1 comprises a connector 10 and a flat flexible cable (FFC) 20 connected to the connector 10. The connector 10, as shown in FIG. 2, includes a housing 100 and a plurality of spring clips 200 disposed in the housing 100.

Figure 2:
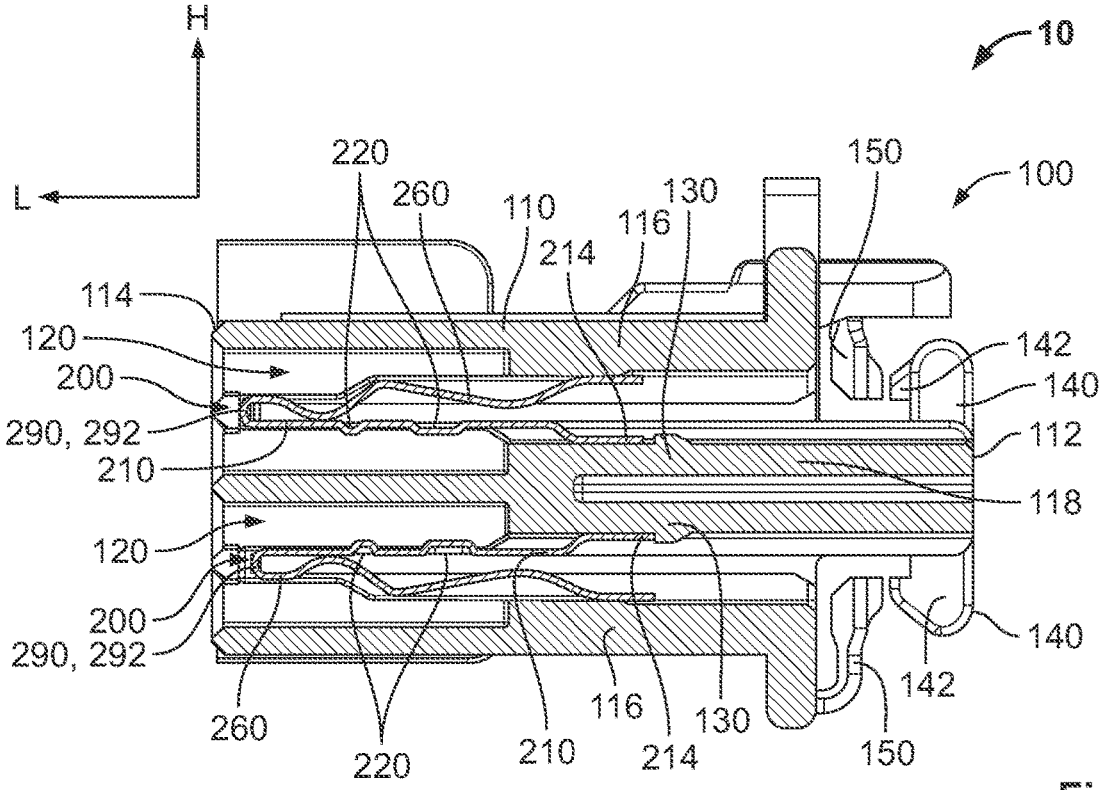
FIG. 2 is a sectional side view of a connector of the connector assembly.

The housing 100, as shown in FIGS. 1 and 2, has a main body 110 extending from a first end 112 to a second end 114 along a longitudinal direction L. The main body 110 includes an outer portion 116 and an inner portion 118 disposed within the outer portion 116. A plurality of receiving passageways 120 extend through the main body 110 along the longitudinal direction L. In the shown embodiment, the receiving passageways 120 are disposed in two rows separated from one another by the inner portion 118 in a height direction H perpendicular to the longitudinal direction L. The receiving passageways 120 in each row are separated from one another along a width direction W perpendicular to both the longitudinal direction L and the height direction H. In other embodiments, the receiving passageways 120 may be disposed in only one row or in more than two rows in the height direction H, and any number of receiving passageways 120 may be disposed in each row in the width direction W.

In each of the receiving passageways 120, as shown in FIG. 2, the housing 100 has a latch 130. In the shown embodiment, the latch 130 extends from the inner portion 118 into the receiving passageway 120 in the height direction H. In other embodiments, the latch 130 could be disposed on any portion of the housing 100 and have any shape provided it is capable of latching one of the spring clips 200 in the receiving passageway 120 as described below.

The housing 100, as shown in FIGS. 1 and 2, has a plurality of posts 140 disposed at the first end 112 and extending away from the inner portion 118 in the height direction H. In the shown embodiment, the posts 140 are each disposed spaced apart from the outer portion 116 along the longitudinal direction L. In the shown embodiment, some of the posts 140 have a post protrusion 142 extending in the longitudinal direction L on a side of the post 140 facing away from the first end 112. In other embodiments, all of the posts 140 or none of the posts 140 may have the post protrusion 142.

The housing 100, as shown in FIGS. 1 and 2, has a plurality of securing elements 150 positioned on an end of the outer portion 116 proximal to the first end 112. The securing elements 150 are each rotatable with respect to the outer portion 116 between an open position and a closed position. In the shown embodiment, the securing elements 150 are each connected to the outer portion 116 by a plastic hinge and are rotatable about the plastic hinge. In other embodiments, the securing elements 150 may be connected to the outer portion 116 by any element that permits rotation of the securing element 150 with respect to the outer portion 116.

The housing 100 is formed of an insulative material, such as a plastic. In the shown embodiment, the housing 100 is monolithically formed in a single piece. In other embodiments, the housing 100 may be formed in a plurality of pieces and assembled to form the housing 100 with the elements described above and shown in FIGS. 1 and 2.

Figure 3:
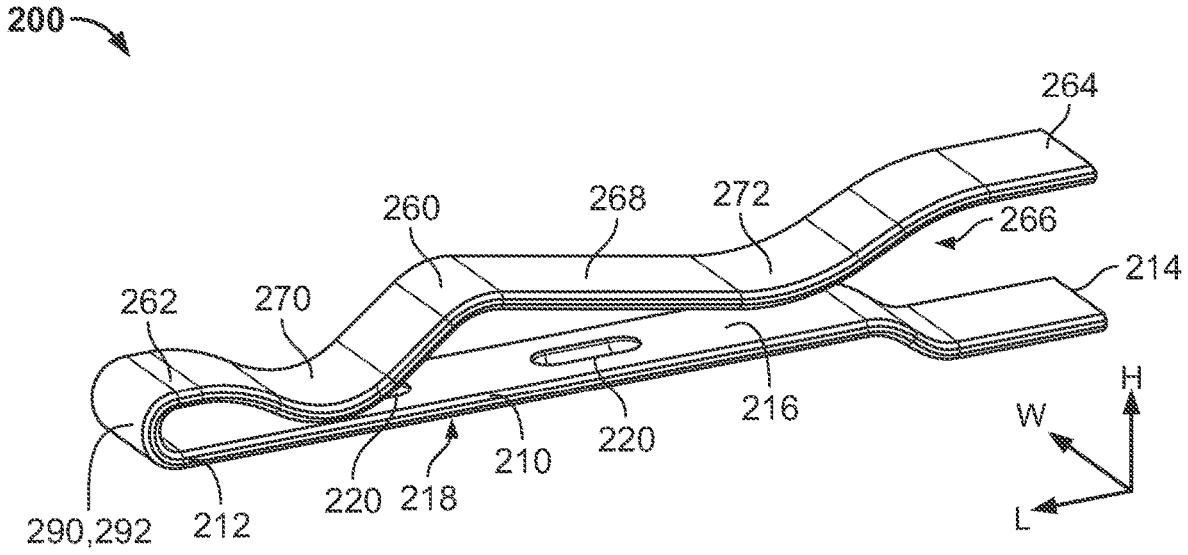
FIG. 3 is a perspective view of a spring clip of the connector.

The spring clip 200, as shown in FIGS. 2 and 3, has a first beam 210 and a second beam 260 connected to the first beam 210 at a connection section 290.

The first beam 210, as shown in FIG. 3, has a first connected end 212 connected to the connection section 290 and extends away from the first connected end 212 along the longitudinal direction L to a first free end 214. The first beam 210 has a first interior surface 216 facing the second beam 260 and a first exterior surface 218 facing away from the second beam 260.

As shown in FIGS. 2 and 3, the first beam 210 has a plurality of support protrusions 220 positioned between the first connected end 212 and the first free end 214 along the longitudinal direction L and extending away from the first exterior surface 218 in the height direction H. In the shown embodiment, the plurality of support protrusions 220 are two support protrusions 220 spaced apart from each other along the longitudinal direction L. In other embodiments, the support protrusions 220 may include only one support protrusion 220 or more than two support protrusions 220 spaced apart from one another along the longitudinal direction L. In an embodiment, the support protrusions 220 may be formed by stamping or bending the first beam 210.

The second beam 260, as shown in FIG. 3, has a second connected end 262 connected to the connection section 290 and extends away from the second connected end 262 along the longitudinal direction L to a second free end 264. The second beam 260 has a second interior surface 266 facing the first beam 210 and a second exterior surface 268 facing away from the first beam 210.

As shown in FIG. 3, the second beam 260 has a first contact bend 270 and a second contact bend 272 between the second connected end 262 and the second free end 264. The first contact bend 270 and the second contact bend 272 extend toward the first beam 210. The first contact bend 270 is positioned proximal to the second connected end 262 and the second contact bend 272 is positioned proximal to the second free end 264. The second contact bend 272 is positioned further from the connection section 290 than the first contact bend 270.

The connection section 290, in the embodiment shown in FIGS. 2 and 3, is a curved portion 292 connecting the first beam 210 and the second beam 260. The second beam 260 is resiliently deflectable toward the first beam 210 about the curved portion 292.

The spring clip 200 is formed of an electrically conductive material. The spring clip 200 may be formed of a single conductive material, such as copper or aluminum, or may be an alloy or include multiple layers of electrically conductive materials. In an embodiment, the spring clip 200 has a coating covering the electrically conductive material, such as a tin coating. In the shown embodiment, the spring clip 200 is monolithically formed in a single piece with the first beam 210, the second beam 260, and the connection section 290. In other embodiments, the spring clip 200 may be formed in a plurality of pieces and assembled to form the spring clip 200 with the elements described above and shown in FIGS. 2 and 3.

To assemble the connector 10, as shown in FIG. 2, the spring clips 200 are each inserted into one of the receiving passageways 120 of the housing 100. The spring clip 200 is inserted from the first end 112 and is moved along the longitudinal direction L toward the second end 114 into the receiving passageway 120. When the spring clip 200 contacts the latch 130 while moving toward the second end 114, the second beam 260 is deflected toward the first beam 210, lessening a dimension of the spring clip 200 in the height direction H and allowing the spring clip 200 to pass the latch 130. When the first free end 214 and the second free end 264 pass the latch 130, the spring clip 200 elastically returns and the second beam 260 moves away from the first beam 210.

In the embodiment shown in FIG. 2, with the spring clip 200 fully inserted into the receiving passageway 120, the first free end 214 is positioned adjacent to the latch 130 and an abutment of the first free end 214 with the latch 130 prevents removal of the spring clip 200 from the receiving passageway 120 in the longitudinal direction L. In other embodiments, the second free end 264 may abut the latch 130 or the latch 130 may have any other shape and may abut any portion of the spring clip 200 to retain the spring clip 200 in the receiving passageway 120. The first exterior surface 218 of the first beam 210 and the second exterior surface 268 of the second beam 260 are exposed in the receiving passageway 120 when the spring clip 200 is fully inserted in the housing 100.

Figure 4:
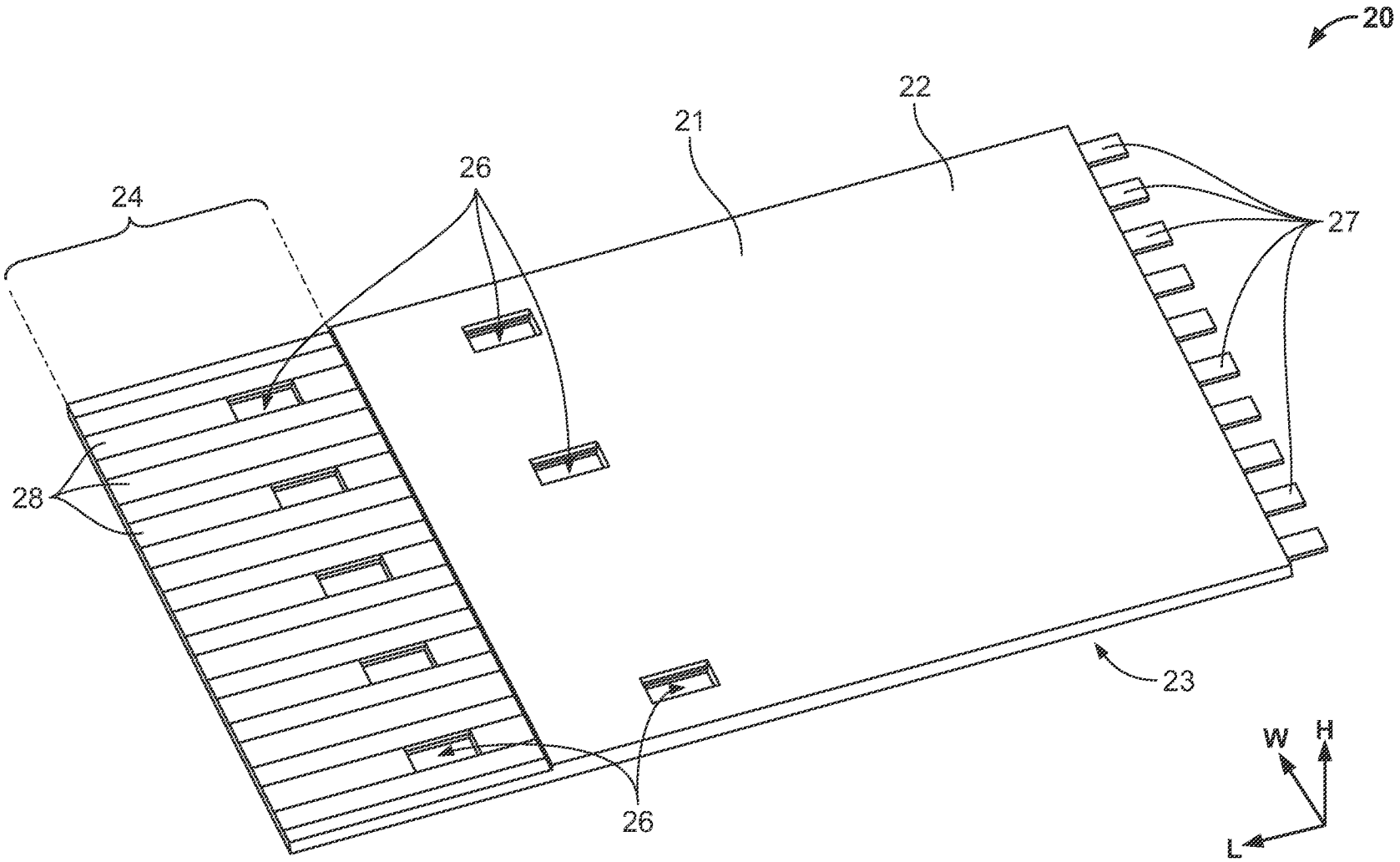
FIG. 4 is a perspective view of a flat flexible cable of the connector assembly.

The FFC 20, as shown in FIGS. 1 and 4, includes an insulation material 21 and a plurality of flat conductors 27 embedded in the insulation material 21. In an embodiment, the flat conductors 27 are each a metallic foil, such as a copper foil, by way of example only, patterned in any desirable configuration. The insulation material 21, such as a polymer insulation material, may be applied to either or both sides of the flat conductors 27 via an adhesive material or extruded directly over the flat conductors 27. The flat conductors 27 may also be referred to as conductors 27 herein.

The insulation material 21, as shown in FIG. 4, has an upper side 22 and a lower side 23 opposite the upper side 22 in the height direction H. The conductors 27 are embedded in the insulation material 21 between the upper side 22 and the lower side 23. The FFC 20, in the embodiment shown in FIG. 4, has a stripped section 24 in which the upper side 22 of the insulation material 21 is removed to expose a first side 28 of the conductors 27. A second side 29 of the conductors 27 opposite the first side 28 in the height direction H is entirely covered with the lower side 23 of the insulation material 21 in the stripped section 24 in the embodiment shown in FIGS. 4 and 5.

The FFC 20 has a plurality of openings 26 extending through the insulation material 21 in the height direction H from the upper side 22 to the lower side 23, as shown in FIGS. 1 and 4. In the embodiment of the FFC 20 with the stripped section 24, the openings 26 can be disposed in or outside of the stripped section 24. In the embodiment shown in FIG. 4, the openings 26 are positioned between conductors 27 in the width direction W. In another embodiment, shown in FIG. 1, the openings 26 can extend through portions of the insulation material 21 outside of the conductors 27 in the width direction W.

Figure 5:
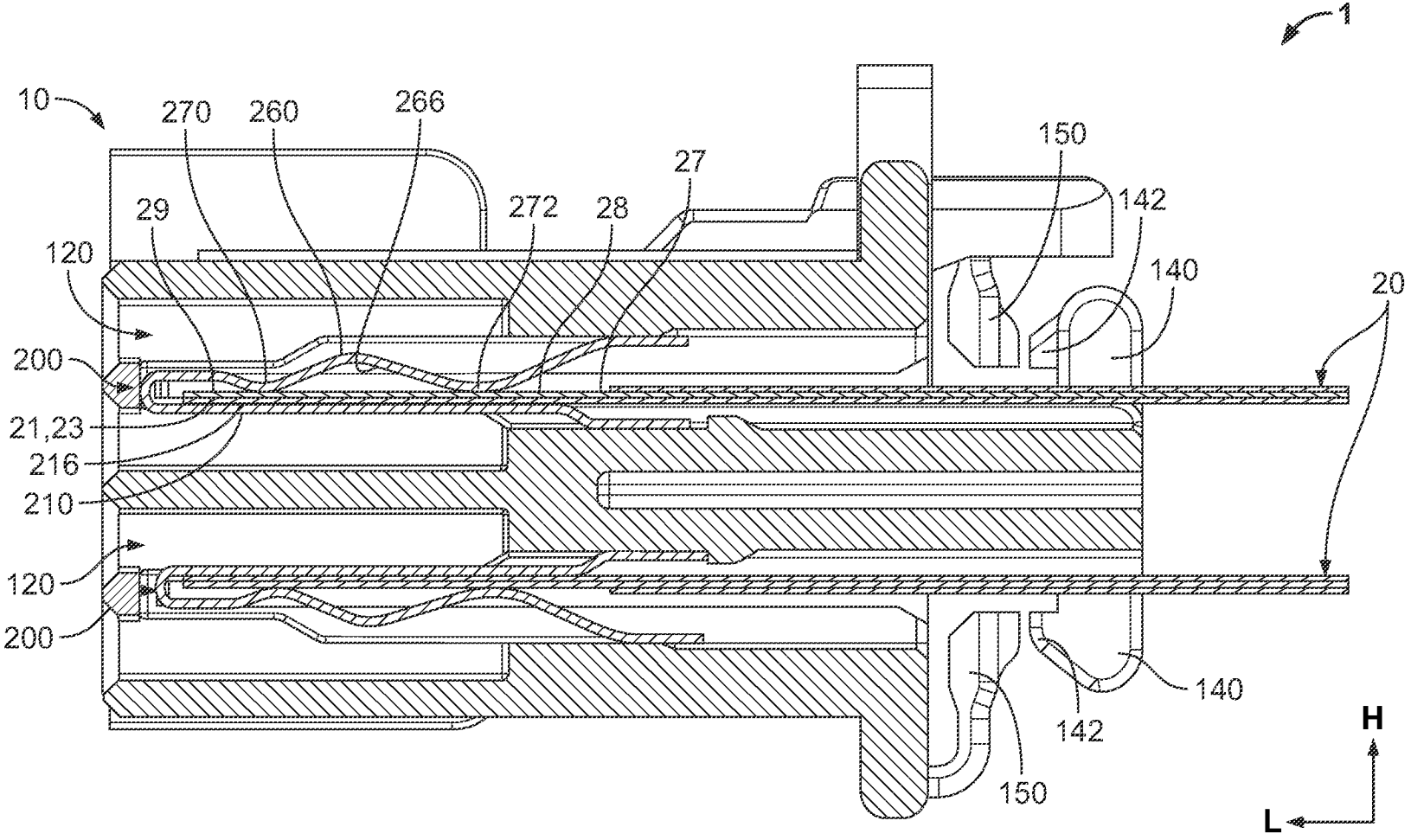
FIG. 5 is a sectional side view of the connector assembly.

As shown in FIGS. 1 and 5, to assemble the FFC 20 with the connector 10 and form the connector assembly 1, the FFC 20 is inserted into the receiving passageways 120 containing the spring clips 200. In FIG. 5, only one of the spring clips 200 and one FFC 20 is provided with reference numbers for clarity of the drawings, however, the reference numbers and corresponding description herein apply equally to the other spring clip 200 and FFC 20 shown in FIG. 5.

As shown in FIG. 5, the FFC 20 is inserted into the receiving passageways 120 along the longitudinal direction L until the FFC 20 is positioned between the first beam 210 and the second beam 260 in the height direction H. Each of the conductors 27 exposed in the stripped section 24 is positioned in one of the receiving passageways 120 and corresponds to one of the spring clips 200.

In a fully inserted position of the FFC 20 shown in FIG. 5, the first interior surface 216 of the first beam 210 abuts the lower side 23 of the insulation material 21 and is separated from the second side 29 of the conductor 27 by the insulation material 21. The first contact bend 270 and the second contact bend 272 abut the first side 28 of the conductor 27 in the stripped section 24 with the second interior surface 266 of the second beam 260. The first contact bend 270 and the second contact bend 272 electrically connect the spring clip 200 with the conductor 27 of the FFC 20 at multiple contact points.

As shown in FIGS. 1 and 5, the posts 140 each extend through one of the openings 26 in the insulation material 21. The posts 140 position the FFC 20 and mechanically secure the position of the FFC 20 relative to the housing 100 and the spring clips 200, providing strain relief if the FFC 20 is pulled or otherwise moved while in the assembled position.

With the FFC 20 fully inserted into the connector 10, the securing elements 150 are pivoted down into the closed position shown in FIGS. 1 and 5. The securing elements 150 are each aligned with one of the post protrusions 142 along the longitudinal direction L, preventing the securing elements 150 from rotating back to the open position. The securing elements 150 further secure the position of the FFC 20 relative to the housing 100 and the spring clips 200, providing both strain relief and position assurance.

In other embodiments, instead of the posts 140 and the securing elements 150, the housing 100 may have any other types of position assurance and strain relief members to position and secure the FFC 20 relative to the housing 100 and the spring clips 200.

In the embodiment shown in FIG. 5, one FFC 20 is inserted into each row of receiving passageways 120. In the embodiment shown in FIG. 1, one FFC 20 is inserted into a bottom row of receiving passageways 120 and a pair of separated FFCs 20 are inserted into a top row of receiving passageways 120. In other embodiments, the housing 100 may have only one row of receiving passageways 120 and one FFC 20 inserted into the row of receiving passageways 120 and electrically connecting to the spring clips 200 in the same manner as shown and described with respect to FIG. 5. The number of conductors 27 of the FFC 20 and the corresponding number of spring clips 200 and receiving passageways 120 in each row can also vary from the shown embodiment and can be any number desirable for various applications.

The connector assembly 1 provides a flexible arrangement that, with the same spring clips 200 while varying the receiving passageways 120 in the housing 100 and the conductors 27 in the FFC 20, can be arranged and connected in various combinations to fit a wide range of applications. Further, the electrical connection of the FFC 20 with the spring clips 200 without crimping or soldering simplifies and lessens the time necessary to assemble the connector assembly 1.

Figure 6:
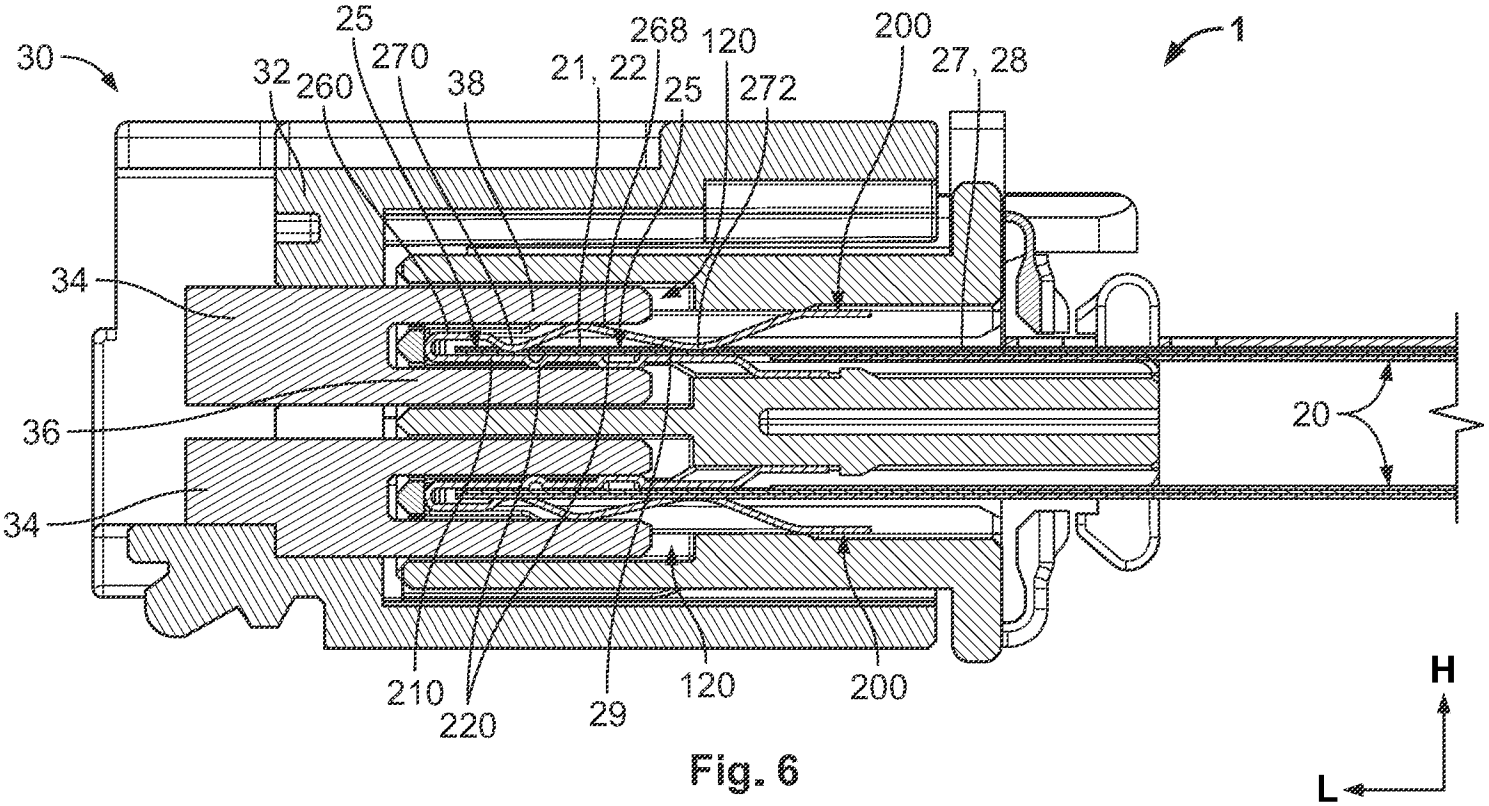
FIG. 6 is a sectional side view of the connector assembly mated with a mating header.

The connector assembly 1, as shown in FIG. 6, is matable with a mating header 30. The mating header 30 includes a mating housing 32 and a plurality of tuning forks 34 disposed in the mating housing 32. Each of the tuning forks 34 has a first prong 36 and a second prong 38 spaced apart from one another along the height direction H. The tuning forks 34, in an embodiment, are each monolithically formed in a single piece from a conductive material.

In FIG. 6, only one of the tuning forks 34, one of the spring clips 200, and one FFC 20 is provided with reference numbers for clarity of the drawings, however, the reference numbers and corresponding description herein apply equally to the other tuning fork 34, the other spring clip 200, and the other FFC 20 shown in FIG. 6.

Figure 9:
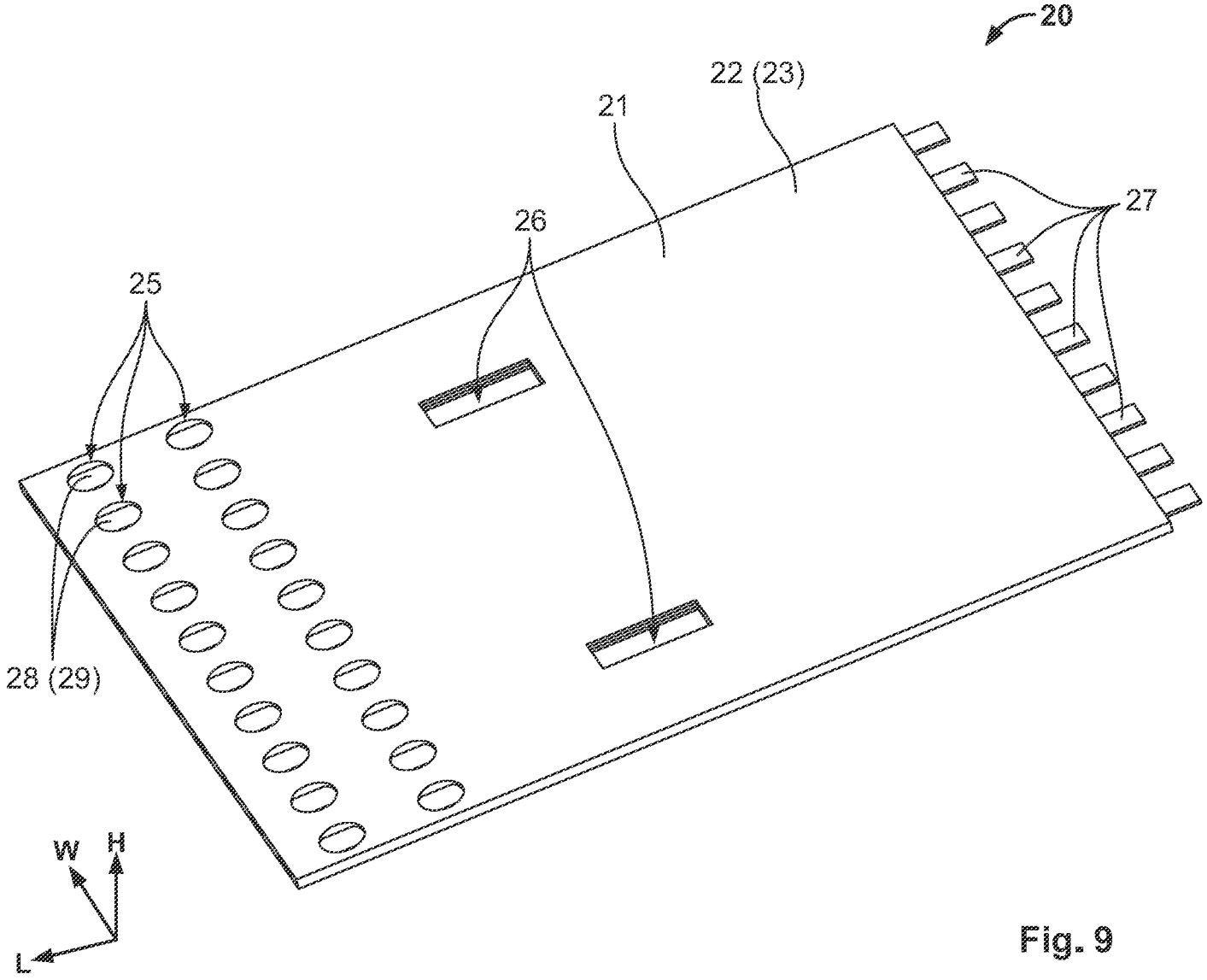
FIG. 9 is a perspective view of a flat flexible cable according to another embodiment.

The connector assembly 1, by way of example only, is shown with an FFC 20 according to another embodiment in FIG. 6. The FFC 20 of FIG. 6 is also shown in FIG. 9. Like reference numbers indicate like elements and the differences with respect to the FFC 20 shown in FIG. 4 will be primarily described herein.

The FFC 20 of FIGS. 6 and 9 does not have the stripped section 24 of the FFC 20 of FIG. 4 on the upper side 22 and, instead, has a plurality of windows 25 extending through a side 22, 23 of the insulation material 21. Each of the windows 25 exposes only a portion of a side 28, 29 of one of the conductors 27. The windows 25 expose the conductors 27 while increasing a quantity of insulation material 21 in comparison to the embodiment of FIG. 4 having the stripped section 24, increasing a stiffness of the FFC 20.

The windows 25, as indicated in FIG. 9, could be formed on either of the sides 22, 23 of the insulation material 21 to expose one of the sides 28, 29 of the conductors 27, as shown in FIG. 6, and the other side 28, 29 of the conductor 27 could either be stripped, as shown in FIG. 6, or have a solid layer of the insulation material 21, as similarly shown in FIG. 5. Alternatively, the windows 25 could be formed on both sides 22, 23 of the insulation material 21 to expose portions of both of the sides 28, 29 of the conductors 27.

As shown in FIGS. 6 and 9, a pair of windows 25 are aligned with each of the conductors 27 and spaced apart from one another along the longitudinal direction L to exposed multiple portions of each conductor 27. The windows 25 are each oval-shaped in the shown embodiment but, in other embodiments, could be any shape that exposes the side 28, 29 of one of the conductors 27. Only some of the conductors 27 and some of the windows 25 are labeled in FIGS. 6 and 9 for clarity of the drawings.

In the connector assembly 1 shown in FIG. 6, the first contact bend 270 and the second contact bend 272 each extend through one of the windows 25 in the upper side 22 of the insulation material 21 and abut the first side 28 of the conductor 27. The first beam 210 abuts the stripped second side 29 of the conductor 27. In another embodiment, the spring clip 200 could contact the FFC 20 according to the embodiment shown in FIG. 5 and still be mated with the mating header 30 in the same manner as described below.

As shown in FIG. 6, when the connector assembly 1 is mated with the mating header 30, each of the tuning forks 34 is inserted into one of the receiving passageways 120. The first prong 36 contacts the support protrusions 220 of the first beam 210 and the second prong 38 contacts the second exterior surface 268 of the second beam 260. The tuning fork 34 is stiffer than the spring clip 200 and the abutment of the prongs 36, 38 with the beams 210, 260 resiliently deflects the second beam 260 toward the first beam 210. The deflection presses the beams 210, 260 toward one another in the height direction H and increases a contact force of the first contact bend 270 and the second contact bend 272 on the conductor 27.

The abutment of the prongs 36, 38 with the beams 210, 260, as shown in FIG. 6, electrically connects the tuning fork 34 with the FFC 20 through the spring clip 200 while providing the increased contact force that improves the electrical connection of the spring clip 200 with the conductor 27. In the embodiment shown in FIG. 6, the contact of the first prong 36 with the two support protrusions 220 and the contact of the second prong 38 at one point on the second beam 260 between the support protrusions 220 along the longitudinal direction L prevents rotation and improves vibration resistance of the connection.

Figure 7:
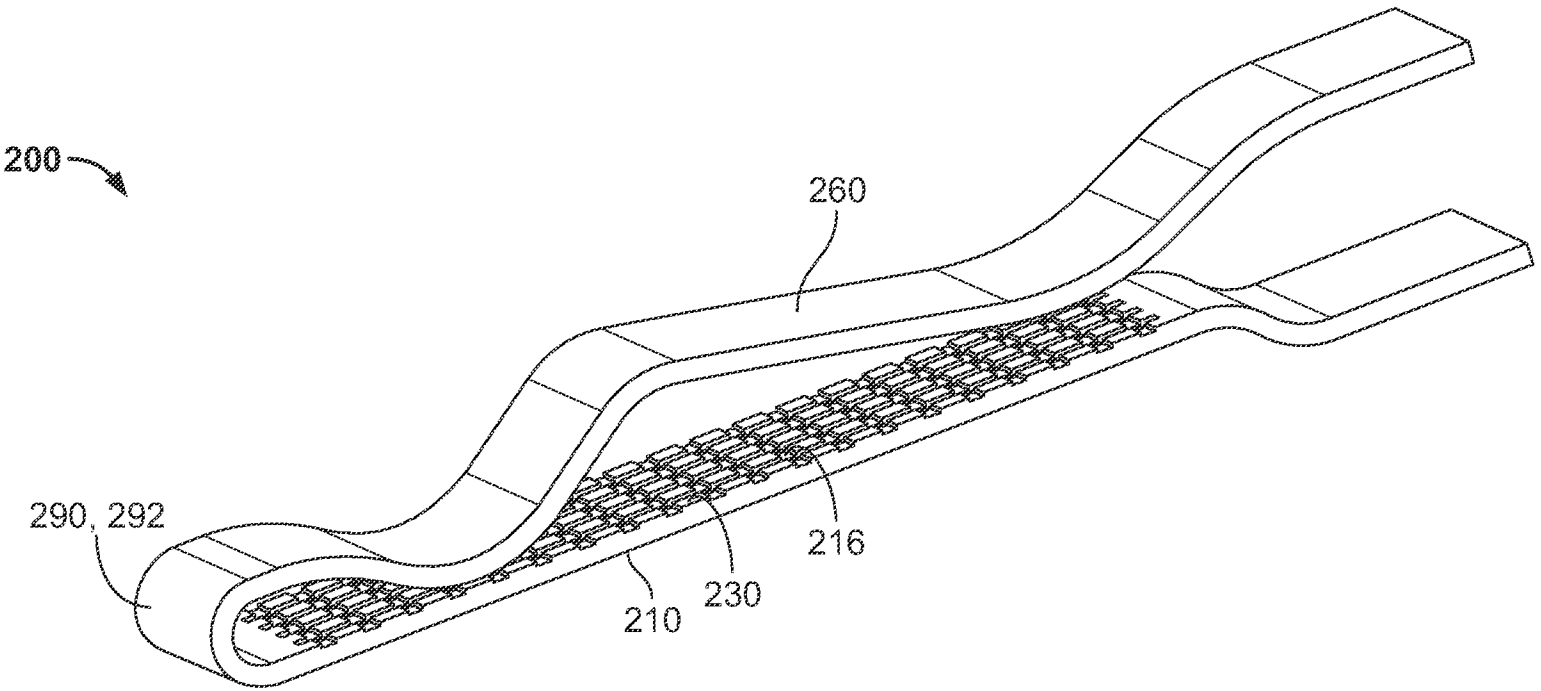
FIG. 7 is a perspective view of a spring clip according to another embodiment.

A spring clip 200 according to another embodiment is shown in FIG. 7. Like reference numbers indicate like elements and the differences with respect to the spring clip 200 show in FIG. 3 will be primarily described herein. The spring clip 200 of FIG. 7 includes a plurality of serrations 230 on the first interior surface 216 facing the second beam 260. The serrations 230 can be in any form and quantity that provides a roughened texture on the first interior surface 216. In the assembled connector assembly 1, arranged similarly to the embodiment shown in FIG. 5, the serrations 230 engage the lower side 23 of the insulation material 21 that separates the first beam 210 from the second side 29 of the conductor 27. The engagement of the serrations 230 with the lower side 23 further secures the position of the FFC 20 with respect to the spring clip 200.

Figure 8:
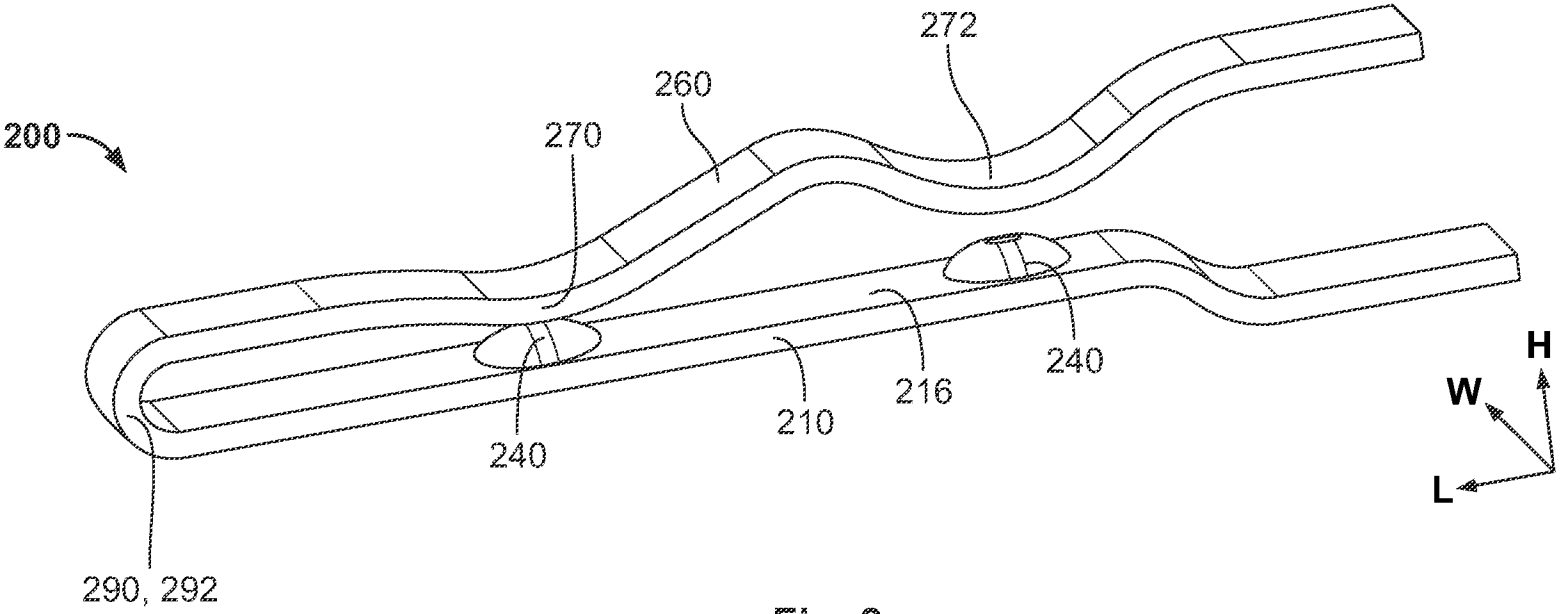
FIG. 8 is a perspective view of a spring clip according to another embodiment.

A spring clip 200 according to another embodiment is shown in FIG. 8. Like reference numbers indicate like elements and the differences with respect to the spring clip 200 shown in FIG. 3 will be primarily described herein. The spring clip 200 of FIG. 8 includes a pair of contact protrusions 240 extending from the first interior surface 216 toward the second beam 260 in the height direction H. The contact protrusions 240 are spaced apart from one another along the longitudinal direction L. In the shown embodiment, one of the contact protrusions 240 is aligned with the first contact bend 270 along the longitudinal direction L and the other of the contact protrusions 240 is aligned with the second contact bend 272 along the longitudinal direction L. The contact protrusions 240 may be formed by stamping or bending the first beam 210.

Figure 10:
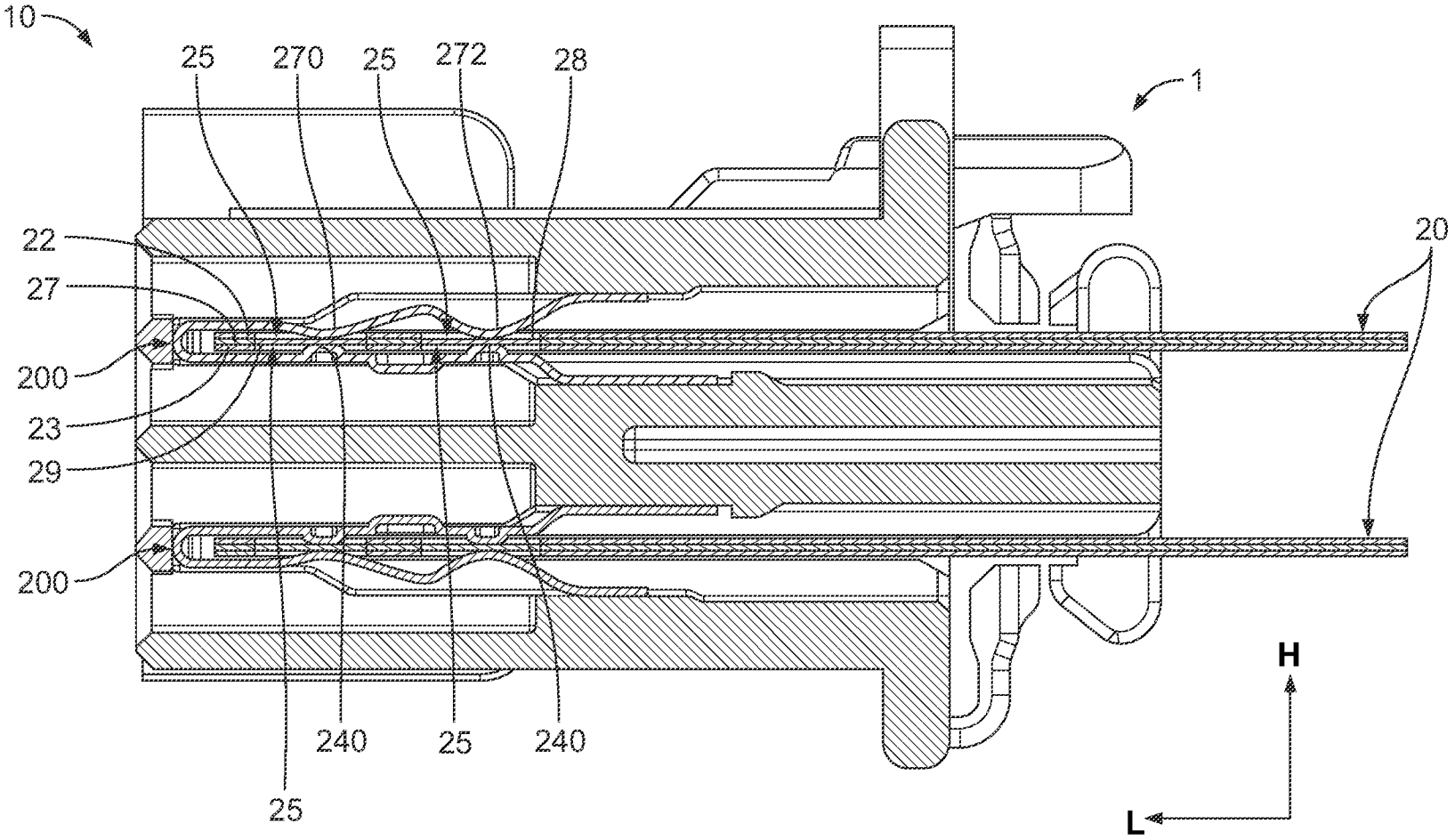
FIG. 10 is a sectional side view of a connector assembly according to another embodiment.

A connector assembly 1 including the spring clip 200 of FIG. 8 and the FFC 20 of FIG. 9 is shown in FIG. 10. The assembly and connections of the connector assembly 1 of FIG. 10 is similar to the connector assembly 1 of FIG. 5 and primarily the differences from the embodiment of FIG. 5 will be described herein. In FIG. 10, only one of the spring clips 200 and one FFC 20 is provided with reference numbers for clarity of the drawings, however, the reference numbers and corresponding description herein apply equally to the other spring clip 200 and FFC 20 shown in FIG. 10.

In the fully inserted position of the FFC 20 shown in FIG. 10, the contact protrusions 240 each extend through one of the windows 25 in the lower side 23 of the insulation material 21 and electrically contact the second side 29 of the conductor 27. The first contact bend 270 and the second contact bend 272 each extend through one of the windows 25 in the upper side 22 of the insulation material 21 and abut the first side 28 of the conductor 27. The first contact bend 270 contacts the conductor 27 opposite one of the contact protrusions 240 and the second contact bend 270 contacts the conductor 27 opposite the other of the contact protrusions 240 to provide four contact points that prevent rotation and improve vibration resistance of the connection.

In another embodiment, the lower side 23 of the insulation material 21 shown in FIG. 10 may be a solid piece of insulation material 21 without the windows 25. In this embodiment, the contact protrusions 240 engage the insulation material 21 and the electrical connection is only made through the contacts bends 270, 272 extending through the windows 25 in the upper side 22.

Figure 11:
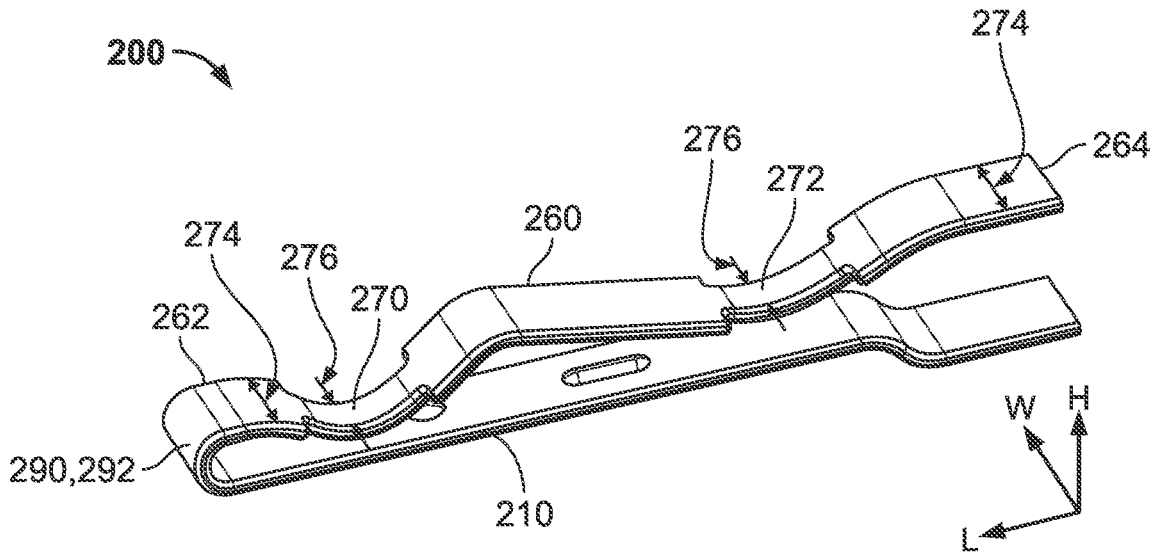
FIG. 11 is a perspective view of a spring clip according to another embodiment.

A spring clip 200 according to another embodiment is shown in FIG. 11. Like reference numbers indicate like elements and the differences with respect to the spring clip 200 shown in FIG. 3 will be primarily described herein. In the spring clip 200 of FIG. 11, the second beam 260 has a beam width 274 in the width direction W at the second connected end 262 and the second free end 264. At the first contact bend 270 and the second contact bend 272, the second beam 260 has a contact width 276 narrower than the beam width 274 in the width direction W. The contact width 276 is sized for the first contact bend 270 and second contact bend 272 to more easily fit through the windows 25 of the insulation material 21, as shown in the embodiment of FIG. 10.

Figure 12:
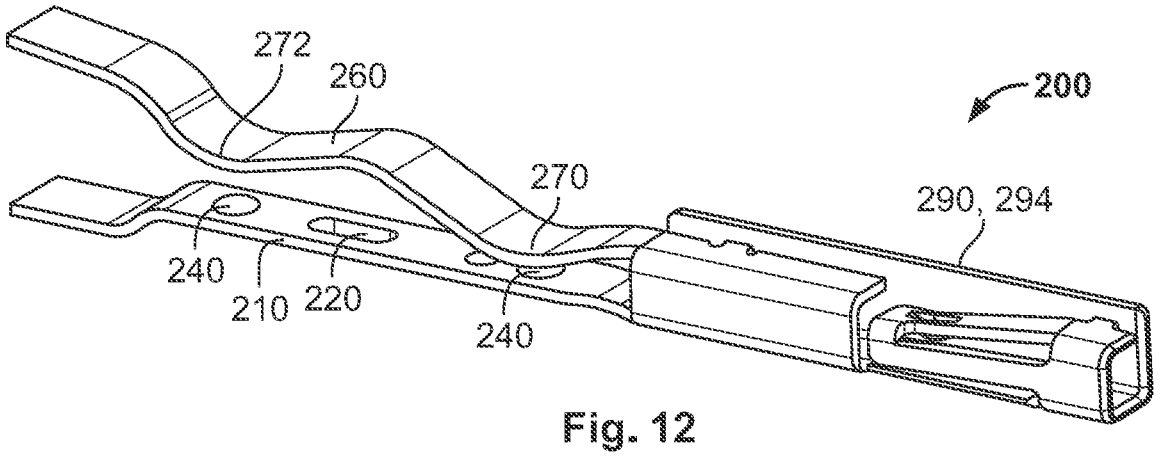
FIG. 12 is a perspective view of a spring clip according to another embodiment.
Figure 13:
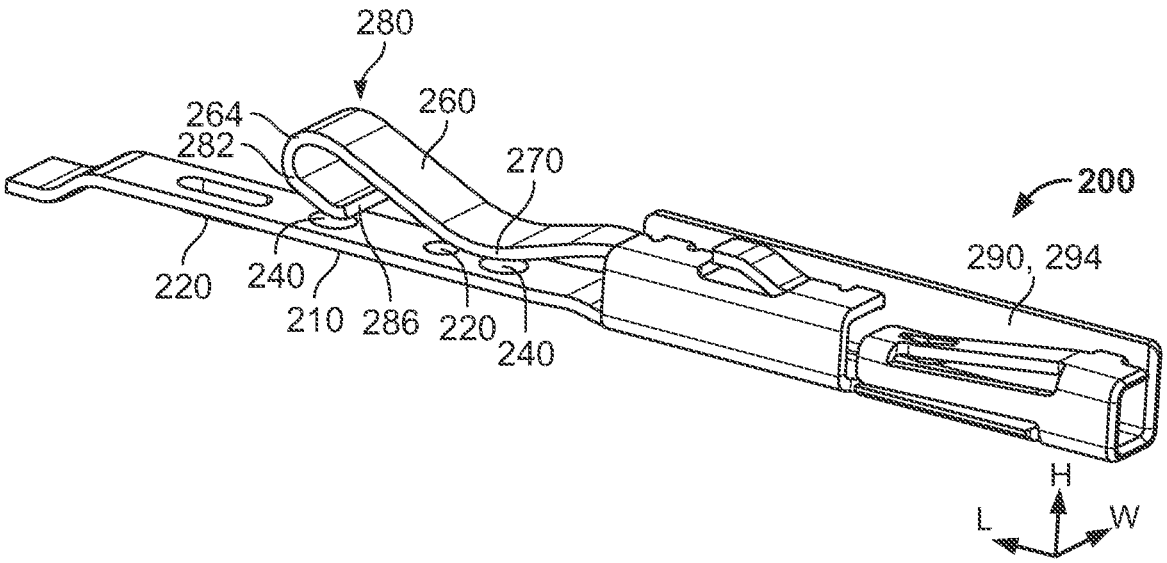
FIG. 13 is a perspective view of a spring clip according to another embodiment.
Figure 14:
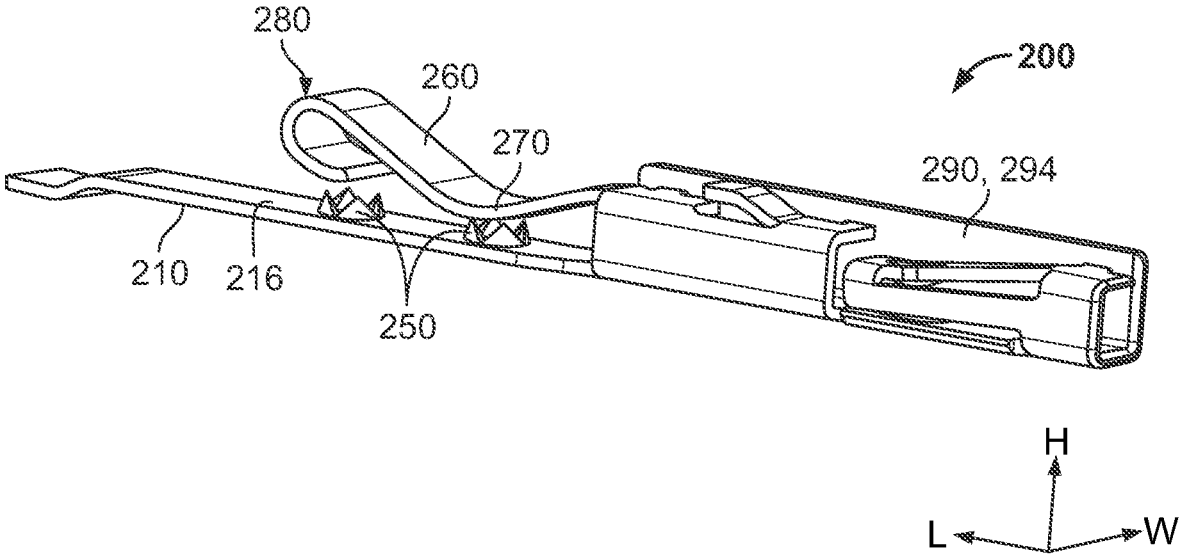
FIG. 14 perspective view of a spring clip according to another embodiment.

Other embodiments of the spring clip 200 are shown in FIGS. 12-14. Like reference numbers indicate like elements and the differences with respect to the spring clip 200 shown in FIG. 3 will be primarily described herein.

The connection section 290 of the spring clip 200 shown in FIG. 12, instead of the curved portion 292 shown in FIG.

3, has a pin interface 294 connecting the first beam 210 and the second beam 260. In the shown embodiment, the pin interface 294 is a box and spring interface adapted to resiliently abut and electrically connect to a contact pin. In other embodiments, the pin interface 294 may be any type of interface adapted to electrically connect to a contact pin that is connected to the first beam 210 and the second beam 260 and permits resilient deflection of the second beam 260 toward the first beam 210.

In another embodiment of the spring clip 200 shown in FIG. 13, the second beam 260 has a friction lock 280 at the second free end 264 in lieu of the second contact bend 272 of the embodiment of FIG. 3. The friction lock 280 includes a bent portion 282 of the second beam 260 bent back toward the connection section 290 and the first beam 210. The bent portion 282 ends in an edge 286 extending in the width direction W. The bent portion 282 can be bent back toward the connection section 290, in various embodiments, at an angle between 90 degrees and 180 degrees, or at any other angle that allows the engagement of friction lock 280 as described below. The friction lock 280 is shown as part of an embodiment including the pin interface 294 as the connection section 290 but could alternatively be used in the same manner with the connection section 290 as the curved portion 292 in the other embodiments described herein.

In another embodiment of the spring clip 200, shown in FIG. 14, the first beam 210 has a pair of piercing elements 250 extending from the first interior surface 216 toward the second beam 260 in place of the contact protrusions 240. Each of the piercing elements 250 is aligned with one of the friction lock 280 and the first contact bend 270 in the height direction H. Each of the piercing elements 250 extends from the first interior surface 216 to a sharp end. In the shown embodiment, the piercing elements 250 each include four sharp points arranged in a ring. In other embodiments, the piercing elements 250 can be any type of element capable of piercing the insulation material 21 of the FFC 20. Although the piercing elements 250 are shown in an embodiment in which the connection section 290 is the pin interface 294, the piercing elements 250 could also be used in place of the contact protrusions 240 in the embodiment of the spring clip 200 shown in FIG. 8, and may be aligned with the second contact bend 272 instead of the friction lock 280.

Figure 15:
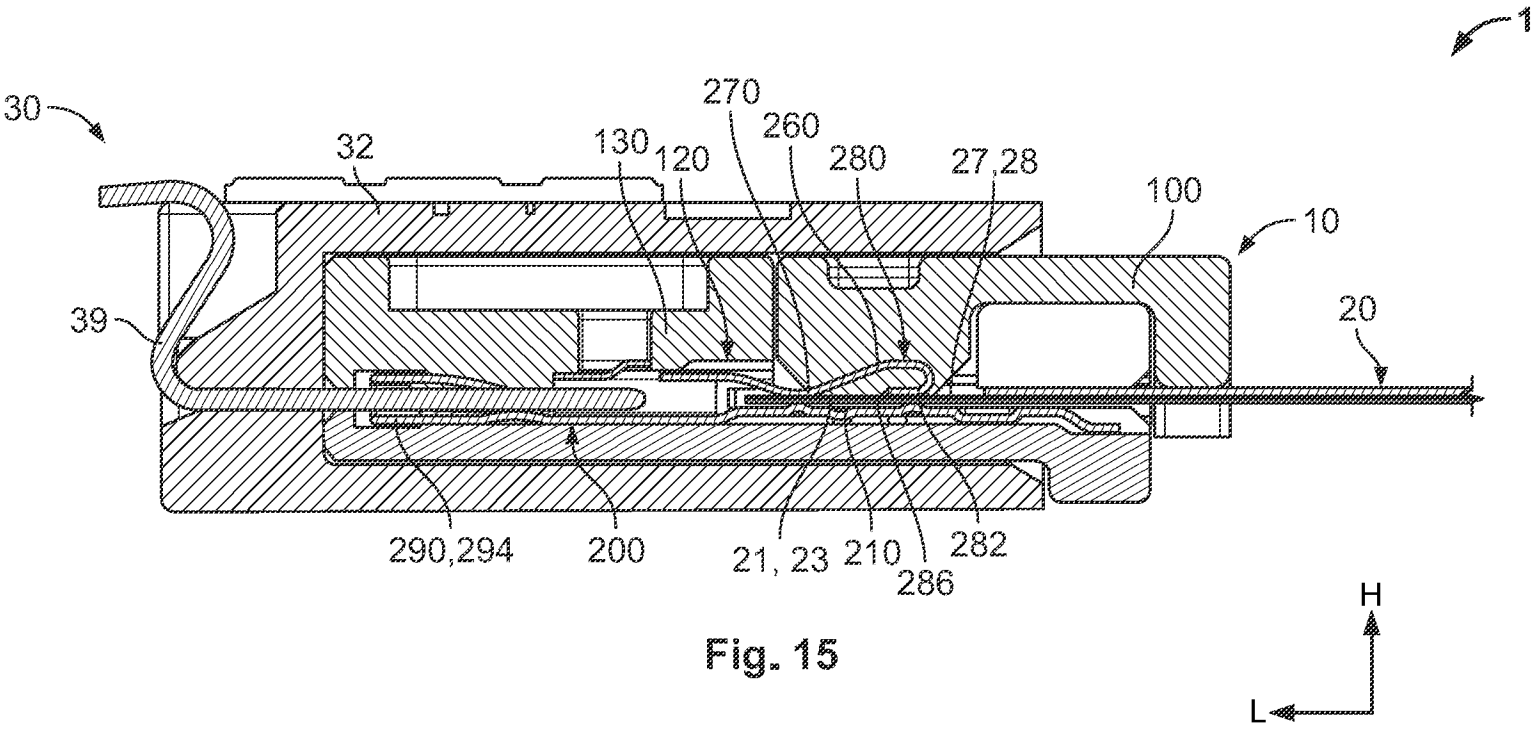
FIG. 15 is a sectional side view of a connector assembly according to another embodiment mated with a mating header according to another embodiment.

A connector assembly 1 including the spring clip 200 of FIG. 13 and the FFC 20 of FIG. 4 is shown mated with a mating header 30 according to another embodiment in FIG. 15. The assembly and connections of the connector assembly 1 and the mating header 30 of FIG. 15 are similar to the connector assembly 1 of FIG. 6 and primarily the differences from the embodiment of FIG. 6 will be described herein.

As shown in FIG. 15, the spring clip 200 is held in the housing 100 with the edge 286 and/or a curved section of the bent portion 282 adjacent to the edge 286 of the friction lock 280 electrically and mechanically engaging the first side 28 of the conductor 27 exposed through the insulation material 21. The first contact bend 270 abuts the first side 28 of the conductor 27. The first beam 210, in the shown embodiment, abuts the lower side 23 of the insulation material 21. In another embodiment, the first beam 210 can have the piercing elements 250 of the embodiment shown in FIG. 14, and the piercing elements 250 can extend through the lower side 23 of the insulation material 21 to electrically and mechanically engage the second side 29 of the conductor 27 and secure the insulation material 21. In other embodiments, the first beam 210 could extend through windows 25 in the lower side 23 or could abut the second side 29 of the conductor 27 with the lower side 23 of the insulation material 21 stripped.

The housing 100 is assembled so as to apply a force pressing the edge 286 and/or the curved section of the bent portion 282 of the friction lock 280 into engagement with the first side 28 of the conductor 27. In an embodiment in which the edge 286 engages the first side 28 of the conductor 27, the edge 286 is arranged so as not to fully cut through the conductor 27. If the FFC 20 is moved or pulled in the longitudinal direction L, the bent portion 282 resists the movement as it resists rotating out of the bent state shown in FIG. 15; the harder the FFC 20 is pulled, the stronger the engagement of the edge 286 and/or the curved section of the bent portion 282 with the conductor 27 and the stronger the resistance to movement of the FFC 20.

In the embodiment shown in FIG. 15, the housing 100 only has one row of receiving passageways 120 and the latch 130 is a passageway extending into an upper side of the receiving passageway 120 in the height direction H. A portion of the pin interface 294 latches to the latch 130 to retain the spring clip 200 in the receiving passageway 120. In other embodiments, the housing 100 shown in FIG. 15 may have more than one row of receiving passageways 120 and, as described above, the number of receiving passageways 120 in each row can vary according to the required application.

The mating header 30, as shown in the embodiment of FIG. 15, has a contact pin 39 disposed in the mating housing 32 instead of the tuning fork 34 of the embodiment shown in FIG. 6. When the connector assembly 1 is mated with the mating header 30 in the embodiment of FIG. 15, the contact pin 39 is inserted into the pin interface 294, electrically and mechanically connecting with the spring clip 200 via the pin interface 294 and electrically connecting with the FFC 20 through the spring clip 200.

What is claimed is:

1. A connector assembly, comprising:

a flat flexible cable having an insulation material and a conductor embedded in the insulation material, the conductor is exposed through a portion of the insulation material; and a spring clip having a first beam and a second beam connected to the first beam and resiliently deflectable toward the first beam, the second beam has a first contact bend and a second contact bend extending toward the first beam, the second contact bend is positioned between the first contact bend and a free end of the second beam, the flat flexible cable is positioned between the first beam and the second beam and the first contact bend and the second contact bend resiliently abut the conductor to electrically connect the spring clip with the conductor.

2. The connector assembly of claim 1, wherein the first beam and the second beam are connected at a connection section and extend away from the connection section, the first beam has a free end opposite the connection section and the free end of the second beam is opposite the connection section.

3. The connector assembly of claim 2, wherein the first beam, the second beam, and the connection section are monolithically formed in a single piece.

4. The connector assembly of claim 2, wherein the connection section is a curved portion about which the second beam is resiliently deflectable.

5. The connector assembly of claim 2, wherein the connection section is a pin interface adapted to electrically connect to a contact pin.

6. The connector assembly of claim 2, wherein the second beam has a friction lock at the free end, the friction lock including a bent portion of the second beam bent back toward the connection section and the first beam.

7. The connector assembly of claim 6, wherein the bent portion of the friction lock ends in an edge electrically and mechanically engaging the conductor exposed through the insulation material of the flat flexible cable.

8. The connector assembly of claim 1, wherein the first beam has a plurality of serrations on an interior surface facing the second beam, the serrations engaging the insulation material of the flat flexible cable.

9. The connector assembly of claim 1, wherein the first beam has a piercing element extending from an interior surface toward the second beam, the piercing element extends through the insulation material and electrically and mechanically engages a side of the conductor opposite the first contact bend.

10. The connector assembly of claim 1, wherein the first beam has a contact protrusion extending from an interior surface toward the second beam, the contact protrusion extending through a window in a portion of the insulation material and electrically contacting a side of the conductor opposite the first contact bend.

11. The connector assembly of claim 1, wherein the first contact bend abuts a side of the conductor exposed in a stripped section of the flat flexible cable in which the insulation material is removed from a side of the flat flexible cable.

12. The connector assembly of claim 1, wherein the first contact bend extends through a window in the insulation material exposing only a portion of the conductor to abut the conductor.

13. The connector assembly of claim 12, wherein the first contact bend has a contact width narrower than a beam width of the second beam in a width direction perpendicular to a longitudinal direction of the second beam.

14. The connector assembly of claim 1, wherein the first beam has a support protrusion extending from an exterior side facing away from the second beam.

15. A connector for a flat flexible cable, comprising:

a housing having a receiving passageway and a post extending through an opening in an insulation material of the flat flexible cable received in the receiving passageway, the housing has a main body with an outer portion and an inner portion disposed within the outer portion, the receiving passageway is defined between the inner portion and the outer portion, the housing has a securing element attached to the outer portion and rotatable with respect to the outer portion between an open position and a closed position, the securing element is rotated to the closed position aligned with the post when the flat flexible cable is received in the receiving passageway; and a spring clip disposed in the receiving passageway, the spring clip having a first beam and a second beam, the second beam connected to the first beam and resiliently deflectable toward the first beam, the second beam has a first contact bend extending toward the first beam, the flat flexible cable is positioned in the receiving passageway between the first beam and the second beam and the first contact bend abuts a conductor exposed through the insulation material of the flat flexible cable to electrically connect the spring clip with the flat flexible cable.

16. The connector of claim 15, wherein the housing has a latch retaining the spring clip in the receiving passageway.

17. The connector of claim 15, wherein the post extends from the inner portion perpendicularly with respect to the receiving passageway.

18. A connector assembly, comprising:

a flat flexible cable having an insulation material and a conductor embedded in the insulation material, the conductor is exposed through a portion of the insulation material; and a connector including a housing and a spring clip disposed in the housing, the spring clip has a first beam and a second beam, the second beam is connected to the first beam and resiliently deflectable toward the first beam, the second beam has a first contact bend extending toward the first beam, the flat flexible cable is positioned between the first beam and the second beam, the first contact bend abuts the conductor exposed through the insulation material to electrically connect the spring clip with the flat flexible cable, the spring clip is matable with a tuning fork of a mating header, the tuning fork has a first prong contacting the first beam and a second prong contacting the second beam to resiliently deflect the second beam toward the first beam.

* * * * *